US009411313B2

(12) United States Patent
Christan et al.

(10) Patent No.: US 9,411,313 B2
(45) Date of Patent: Aug. 9, 2016

(54) BALANCE SPRING STUD-HOLDER

(71) Applicant: ETA SA Manufacture Horlogere Suisse, Grenchen (CH)

(72) Inventors: Julien Christan, Bienne (CH); Laurent Kaelin, Sonvilier (CH); Baptist Wyssbrod, Nidau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/945,900

(22) Filed: Nov. 19, 2015

(65) Prior Publication Data

US 2016/0170375 A1 Jun. 16, 2016

(30) Foreign Application Priority Data

Dec. 11, 2014 (EP) ..... 14197478

(51) Int. Cl.
*G04B 17/32* (2006.01)
*G04B 17/34* (2006.01)

(52) U.S. Cl.
CPC ..... *G04B 17/34* (2013.01); *G04B 17/325* (2013.01)

(58) Field of Classification Search
CPC ..... G04B 17/32; G04B 17/325; G04B 17/34
USPC ..... 368/178
See application file for complete search history.

(56) References Cited

U.S. PATENT DOCUMENTS 440,877 A * 11/1890 Higginbotham ..... G04B 17/325 368/178
1,037,742 A * 9/1912 Dudley ..... G04B 17/325 368/178
3,016,688 A * 1/1962 Rueger ..... G04B 17/325 368/177
7,237,945 B2 * 7/2007 Geyer ..... G04B 18/02 368/175

FOREIGN PATENT DOCUMENTS

CH 76 336 12/1917
IT 583 522 12/1958

OTHER PUBLICATIONS

European Search Report issued Sep. 22, 2015 in European Application 14197478, filed on Dec. 11, 2014 ( with English Translation).

* cited by examiner

*Primary Examiner* — Vit W Miska
(74) *Attorney, Agent, or Firm* — Oblon, McClelland, Maier & Neustadt, L.L.P

(57) ABSTRACT

The present invention concerns an assembly for holding or supporting a timepiece balance spring including a balance spring stud and a stud-holder, wherein said stud-holder includes:

a base (30, 300) comprising a first stop member (32, 320) extending along a longitudinal axis (L) of said base;

means (7) of attaching said stud-holder to a balance-cock (5), characterized in that said stud-holder further includes elastic means (34, 340) provided with a second stop member (36, 360).

15 Claims, 4 Drawing Sheets

BALANCE SPRING STUD-HOLDER

This application claims priority from European Patent application No. 14197478.2 filed Dec. 11, 2014, the entire disclosure of which is hereby incorporated herein by reference.

The present invention concerns an assembly for holding or supporting a timepiece balance spring including a balance spring stud and a stud-holder, wherein said stud-holder includes:

- a base comprising a first stop member extending along a longitudinal axis of said base;
- means of securing said stud-holder to an escapement mechanism.

PRIOR ART

In a mechanical watch, it is usual to use a regulating member comprising a sprung-balance device. Conventionally, the inner end of the balance spring is attached to a collet provided on the balance staff. In order to attach and position the inner end of the balance spring, it is known to use a stud-holder housing a balance spring stud, in association with a clamping screw to clamp the stud against the portion of the balance spring engaged in the stud-holder.

In such an assembly, the stud-holder is conventionally attached to a balance-cock also used for attaching one of the ends of the balance staff. In practice, during assembly and/or timing, the operations to be performed with these various elements are difficult, since access is restricted and the parts are of very small dimensions. Moreover, with such configurations, it is common for the balance spring clamping screw or the balance spring stud-holder to come loose, and/or be lost during an operation such as adjustment of the active length of the balance spring.

SUMMARY OF THE INVENTION

It is an object of the invention to overcome the drawbacks of the prior art by proposing to provide an assembly for holding or supporting a timepiece balance spring which allows simplified assembly or disassembly of the balance spring stud.

To this end, the invention concerns an assembly for holding or supporting a timepiece balance spring including a balance spring stud and a stud-holder, wherein the stud-holder includes:

- a base comprising a first stop member extending along a longitudinal axis of said base;
- and means of securing said stud-holder to a balance-cock, characterized in that said stud-holder further includes elastic means provided with a second stop member, the elastic means extending along said longitudinal axis of said base such that the second stop member is located facing the first stop member, the space between said first stop member and said second stop member forming a housing for said stud, and in that the elastic means are made to naturally exert stress on the stud when the latter is placed in the housing, the housing being capable of enlargement to release the stud by deformation of said elastic means.

One advantage of this invention is that it allows simple assembly/disassembly of the stud.

In a first advantageous embodiment, the elastic means include at least one arm, the free end of said arm bearing the second stop member.

In a second advantageous embodiment, the elastic means comprise two arms extending from said base, the arms being integral with each other and having a convex shape.

In a third advantageous embodiment, the two arms forming the elastic means are symmetrical with respect to the longitudinal axis of said base.

In a fourth advantageous embodiment, the two arms each comprise one notch.

In another advantageous embodiment, the stud-holder is made of a plastic material.

In another advantageous embodiment, the stud-holder is made of a metallic material.

In another advantageous embodiment, the stud-holder is made of a single crystal material.

In another advantageous embodiment, the means of attachment comprise a hole arranged in the balance-cock cooperating with a first hole of the stud-holder and a screw inserted in both holes.

In another advantageous embodiment, the means of attachment further comprise a lug arranged on the balance-cock and a second hole arranged in the stud-holder, said lug cooperating with the second hole.

In another advantageous embodiment, the means of an attachment further comprise a lug arranged on the stud-holder and a second hole arranged in the balance-cock, said lug cooperating with the second hole.

In another advantageous embodiment, the means of attachment further comprise a recess arranged on the balance-cock and a protuberance arranged on the stud-holder, said recess cooperating with said protuberance.

In another advantageous embodiment, the first hole has the shape of an arc of a circle permitting angular pivoting of the stud-holder.

In another advantageous embodiment, the stud-holder and the balance-cock are in one-piece.

BRIEF DESCRIPTION OF THE DRAWINGS

The objects, advantages and features of the invention will appear more clearly in the following detailed description of at least one embodiment of the invention, given solely by way of non-limiting example and illustrated by the annexed drawings, in which.

DETAILED DESCRIPTION

Figure 1A:
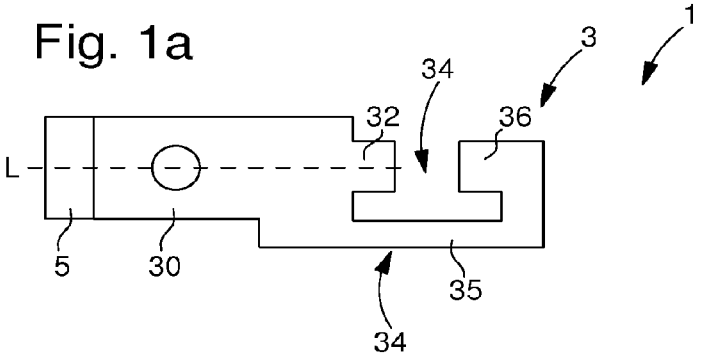
FIGS. 1*a* to 1*d* show a diagram of a first embodiment of the holding assembly according to the invention.

The present invention proceeds from the general idea of providing an assembly for holding or supporting a timepiece balance spring permitting simpler assembly/disassembly of the balance spring stud.

FIGS. 1*a* to 1*d* show schematic views of an assembly 1 for holding or supporting a balance spring stud according to a first embodiment. This holding assembly 1 includes a stud-holder 3 arranged to be attached to the balance-cock 5 by means of attachment 7. The holding assembly also includes a balance spring stud 9 attached to one coil of the balance spring.

Stud-holder 3 includes a base 30 having a longitudinal axis. Base 30 may have any shape. From base 30 there extends a first stop member 32. This first stop member takes the form of a protruding portion of base 30.

Advantageously according to the invention, stud-holder 3 also includes elastic means 30 for provided for the attachment of stud 9 to the stud-holder.

In the first embodiment seen in FIG. 1*a*, the elastic means include an arm 35. This arm 35 extends from base 30 in a similar direction to that of first stop member 32, i.e. in a similar direction to that of the longitudinal axis. This arm 35 has a rectilinear shape ending in a bend and includes a free end on which a second stop member 36 is arranged. Elastic arm 35 and second stop member 36 are formed such that, in an initial position, second stop member 36 is located facing first stop member 32 when elastic arm 34 is in rest mode, i.e. when no stress is applied thereto.

In such case, a space 4 is present between first stop member 32 and second stop member 36, this space forming a housing for stud 9.

Figure 1B:
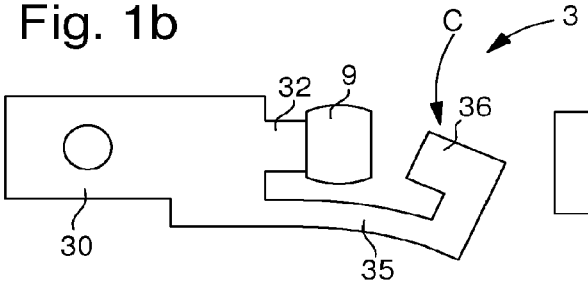
Figure 1C:
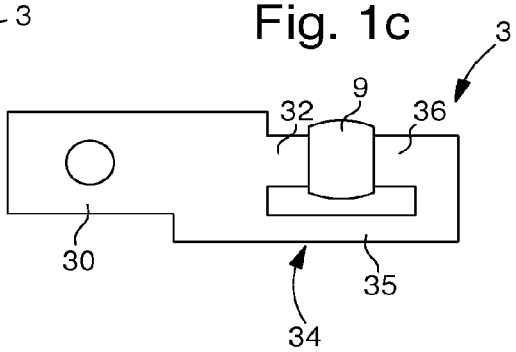

According to the invention, elastic arm 34 is cleverly devised to naturally exert a force on stud 9 when the latter is placed in housing 4 present between first stop member 32 and second stop member 36, as seen in FIG. 1*c*.

Therefore, to assemble or disassemble stud 9 on stud-holder 3, a stress C must be exerted on arm 65. This stress C is exerted on elastic arm 34 so as to elastically deform the arm.

This elastic deformation causes a displacement of second stop member 36 with respect to first stop member 34, as seen in FIG. 1*b*. This displacement is intended to enlarge the housing. This enlargement of housing 4 allows stud 9 to be placed therein or released therefrom. In the case of disassembly of stud 9, the displacement of second stop member 36 with respect to first stop member 32 is intended to decrease the stress applied to stud 9.

This embodiment has the advantage of being simple, since there are no screws or complex operations to be performed. The elastic arm simply has to be moved aside to release stud 9 or insert it in the housing. Further, this system permits assembly or disassembly of the stud without shocks.

Figure 1D:
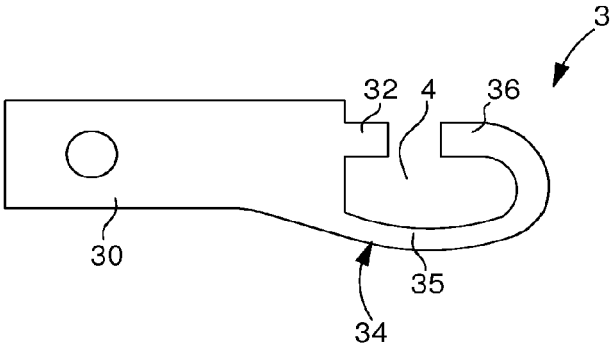

In a variant of this first embodiment, elastic arm 35 has a non-rectilinear shape. For example, the arm may be bent to have a convex or concave profile, as seen in FIG. 1*d*.

Figure 2A:
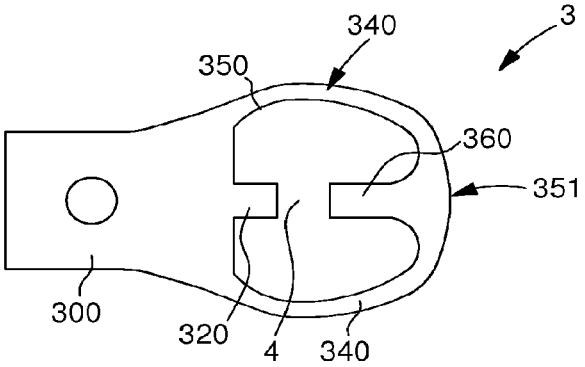
FIGS. 2*a* to 2*d* show a diagram of a second embodiment of the holding assembly according to the invention.

In a second embodiment seen in FIG. 2*a*, elastic means 340 include two elastic arms 350. Each elastic arm 350 includes a first end and a second end. These arms 350 extend from base 300, via the first end, in a similar direction to that of first stop member 320, i.e. in a similar direction to that of the longitudinal axis.

In this second embodiment, the two elastic arms 350 are joined at their second end. At this joining point 351, second stop member 360 is arranged to face first stop member 320.

Figure 2B:
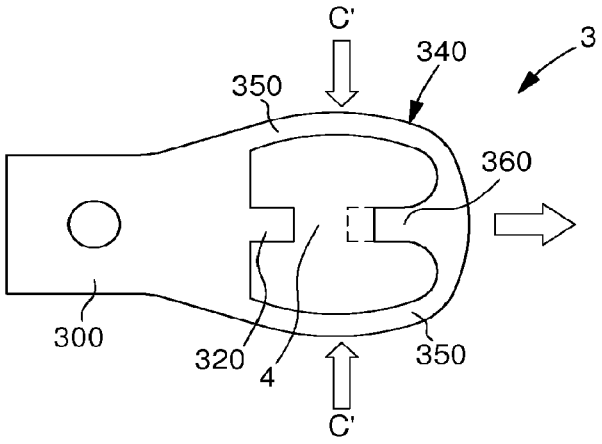

According to the invention, the two elastic arms 350 cleverly each have a curvature. This curvature is preferably convex. This convex shape of elastic arms 350 permits simplified assembly/disassembly of stud 9. Indeed, in order to assemble/disassemble the stud, a stress C' is simultaneously applied to the two elastic arms 350. This stress C' applied to each elastic arm 350 causes a deformation of arms 350. This deformation is intended to bring them closer together as seen in FIG. 2*b*.

It is thus observed that the deformation of arms 350 causes a displacement of second stop member 360. This displacement of the second stop member is characterized in that said second stop member 360 moves away from first stop member 320 thereby enlarging housing 4 located between first stop member 320 and second stop member 360.

The enlargement of the housing thus allows stud 9 to be easily placed therein or removed therefrom.

When the operator wishes to assemble the stud, he applies a stress C' on both elastic arms 350. This stress or pressure C' can be applied using a tool such as a clamp. The stress C' applied by the operator is intended to deform arms 350 so that the second stop member 360 is displaced and enlarges the housing.

Figure 2C:
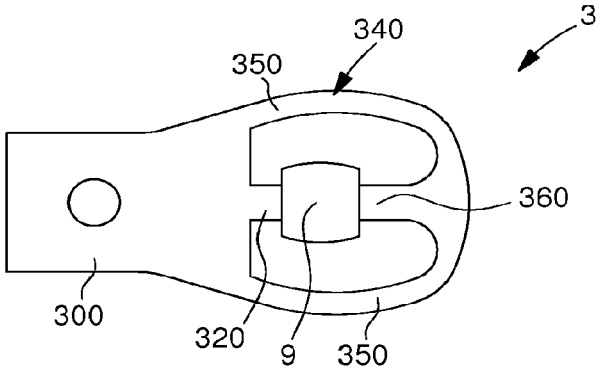

The operator then takes stud 9 and places it in abutment on first stop member 320. The latter may be provided with a notch for immobilising stud 9. When stud 9 is immobilised on first stop member 320, the operator releases pressure C' exerted on elastic arms 350 causing a displacement of second stop member 360. This displacement tends to move second stop member 360 closer to first stop member 320 until second stop member 360 enters into contact with stud 9 as seen in FIG. 2*c*. Stud 9 will be dimensioned to be larger than housing 4. Consequently, when second stop member 360 moves to return to the initial position, i.e. the position where elastic arms 350 are at rest, it cannot return to its exact initial position because of the larger size of stud 9.

Second stop member 360 therefore exerts a force on said stud 9 in order to hold it between first stop member 320 and second stop member 360.

When the operator wishes to disassemble stud 9, he exerts a stress such as a pressure C' on elastic arms 350. This pressure causes a deformation of elastic arms 350 and consequently a displacement of second stop member 360. This displacement enlarges housing 4 thereby releasing stud 9 so that the operator can grasp it.

Figure 2D:
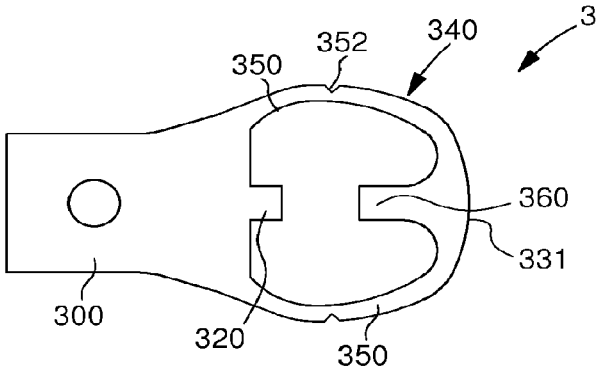

In a variant of this second embodiment visible in FIG. 2*d*, each elastic arm includes a notch 352 on the outer surface thereof. These notches 352 are used as specific areas enabling the tool used to exert pressure on elastic arms 352 be positioned thereon and not slide during assembly or disassembly.

To secure the stud-holder to the balance-cock, means of attachment 7 are provided.

Figure 3A:
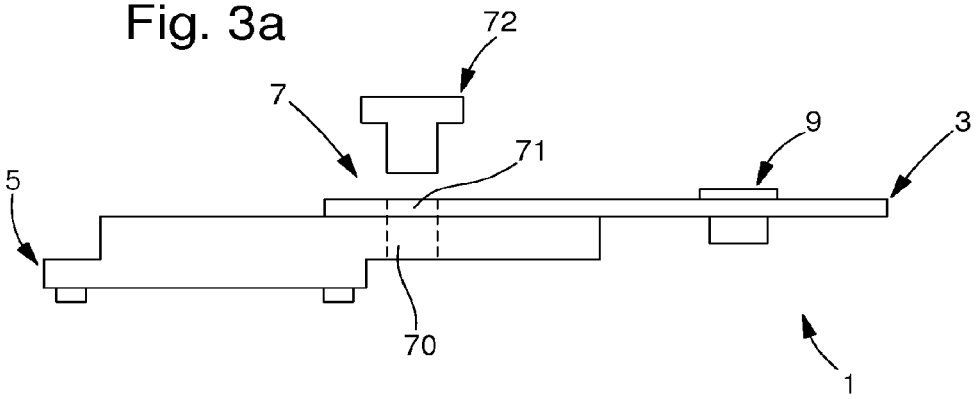
FIGS. 3*a* to 3*b* show a diagram of a first alternative of the means of attachment according to the invention.
Figure 3B:
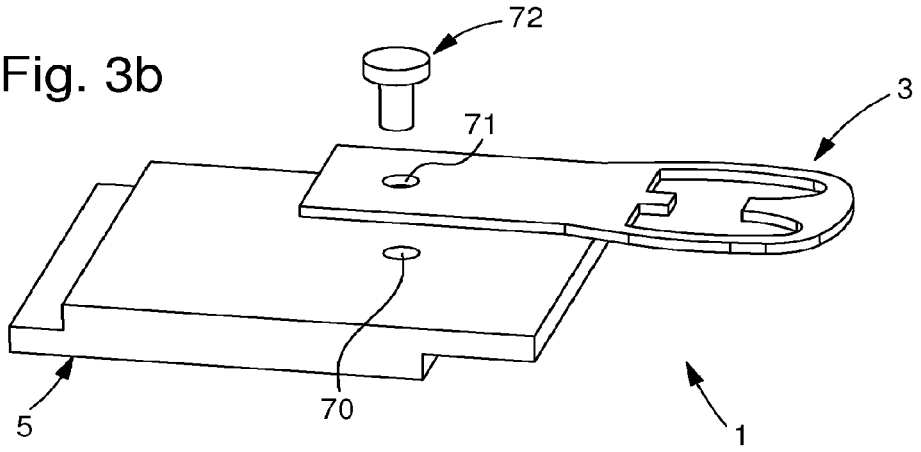

In a first alternative seen in FIGS. 3*a* and 3*b*, means of attachment 7 include a hole 70, which may or may not be a through hole, arranged in the balance-cock associated with a through hole 71 arranged in the stud-holder. These two holes allow a screw 72 to be used to secure the stud-holder to the balance-cock. This single screw 72 for attaching stud-holder 3 to balance-cock 5 can be used as the axis of rotation. Indeed, it is possible to envisage using this single point of attachment to permit angular adjustment of the stud-holder, with the operator turning the stud-holder about the axis of the screw.

Figure 4A:
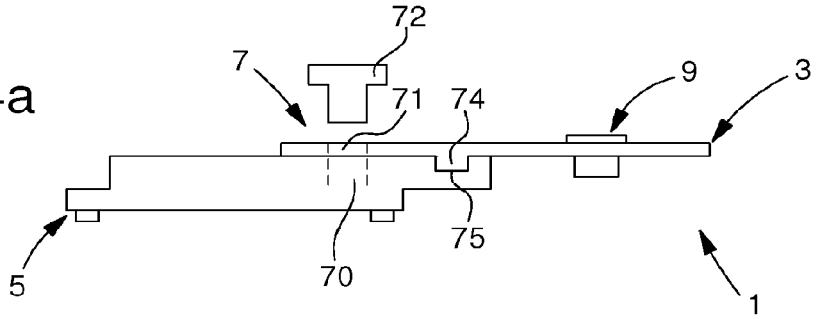
FIGS. 4*a* to 4*c* show a diagram of a second alternative of the means of attachment according to the invention.
Figure 4B:
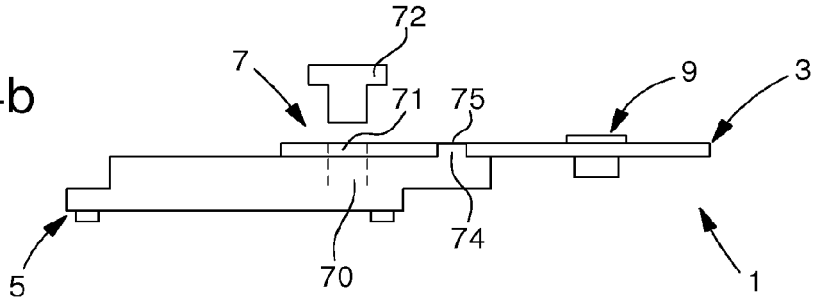
Figure 4C:
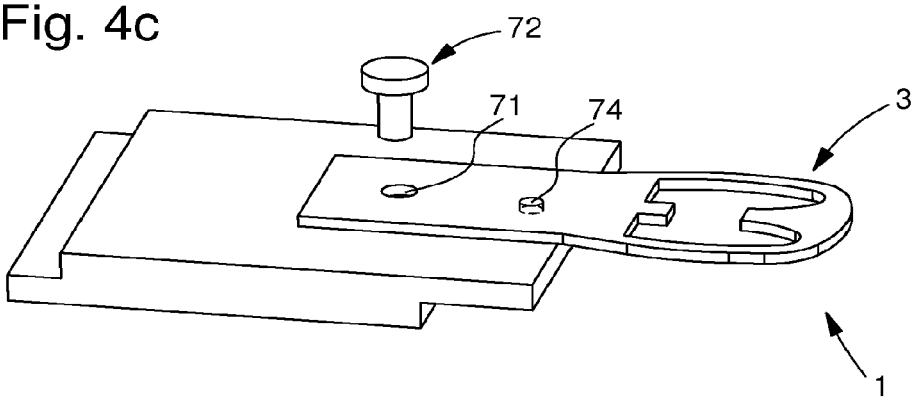

In a second alternative seen in FIG. 4*a*, means of attachment 7 include a hole 70, which may or may not be a through hole, arranged in balance-cock 5 and a first through hole 71 arranged in stud-holder 3. These two holes allow screw 72 to be used to secure stud-holder 3 to balance-cock 5. Means of attachment 7 further include a lug 74 and a second hole 75, which may or may not be a through hole. Lug 74 may be arranged on stud-holder 3 and second hole 75 may be arranged in the balance-cock as seen in FIG. 4*a* or, vice versa, as seen in FIGS. 4*b* and 4*c*.

This pair comprising lug 74—second hole 75 is used to stabilise the position of stud-holder 3 with respect to balance-cock 5. Indeed, the presence of lug 74, which is inserted in second hole 75, makes it possible to block angular movements when the operator is securing screw 72. Indeed, without the presence of lug 74, there is a risk of angular displacement of stud-holder 3 when screw 72 is tightened to secure stud-holder 3 to balance-cock 5.

Figure 5:
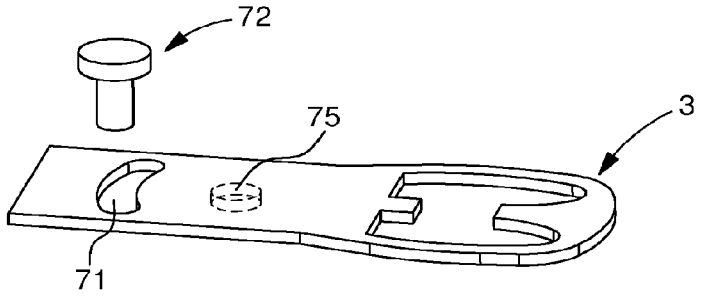
FIG. 5 shows a diagram of a variant of the second alternative of the means of attachment according to the invention.

In a variant of the second alternative seen in FIG. 5, first hole 71 arranged in stud-holder 3 in which screw 72 is inserted, can take the form of an oblong hole or of a groove. This groove forms an arc of a circle to allow adjustment of the angular position of stud-holder 3. In that case, lug 74 is used as a pivot axis, once the screw is loosened, enabling stud-holder 3 to be pivoted to adjust its position.

Figure 6:
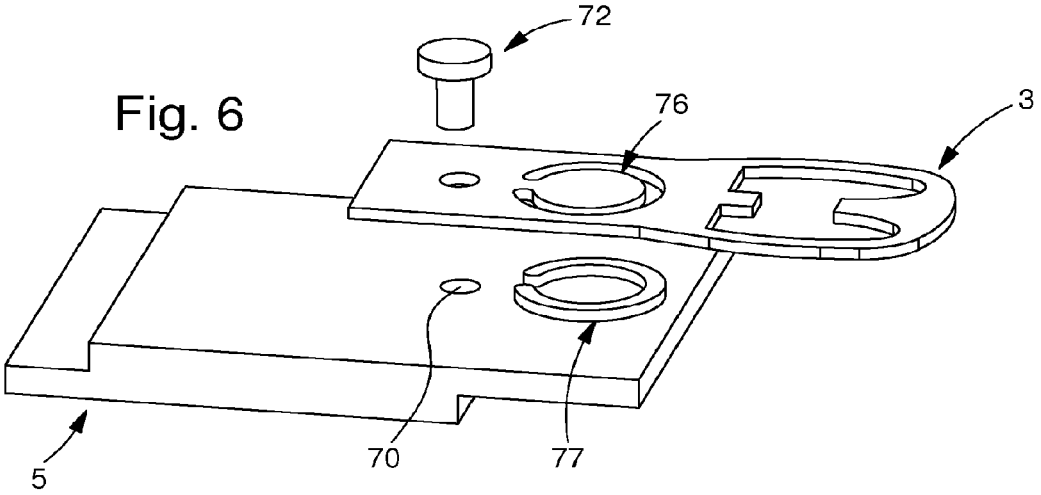
FIG. 6 shows a diagram of a third alternative of the means of attachment according to the invention.

In a third alternative seen in FIG. 6, means of attachment 7 include a hole 70, which may or may not be a through hole, arranged in balance-cock 5 and a first through hole 71 arranged in stud-holder 3. These two holes allow a screw 72 to be used to secure the stud-holder to the balance-cock. Means of attachment 7 further include guide means used to stabilise the position of the stud-holder and to act as a pivot axis for the angular adjustment of said stud holder. To achieve this, the guide means include a recess 76 to arranged in the stud-holder and a protuberance or projecting portion 77 arranged on the balance-cock. This recess 76 and protuberance 77 are made to be able to cooperate with each other, protuberance 77 being capable of penetrating recess 76. Recess 76 has the shape of an arc of a circle. When stud-holder 3 is mounted on balance-cock 5, protuberance 77 is inserted in recess 76 to limit the movements of said stud-holder 3 with respect to balance-cock 5.

Protuberance 77 could be dimensioned to allow stud-holder 3 no freedom of movement or, conversely, it could be dimensioned to allow angular adjustment of the position of the stud-holder. In the example where protuberance 77 and recess 76 have the shape of an arc of a circle, if the recess has a larger angle than the protuberance, then the stud-holder could be adjustable if hole 70 is also in the shape of an arc of a circle.

Figure 7:
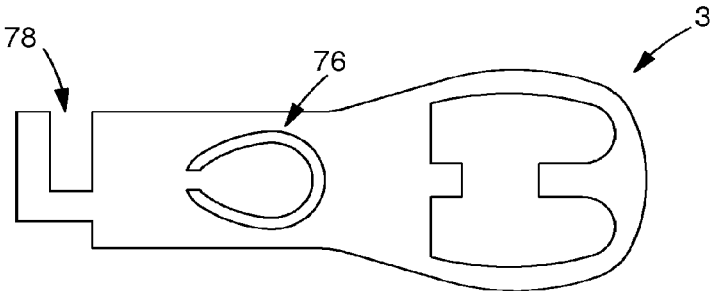
FIG. 7 shows a diagram of a fourth alternative of the means of attachment according to the invention.

In a fourth alternative, means of attachment 7 include the guide means used for the third alternative, i.e. a recess 76 arranged on the stud-holder and a protuberance 77 arranged on the balance-cock. Means of attachment 7 further include a brake 78. This brake 78 seen in FIG. 7 consists of a flexible arm. The flexible arm extends from the base in an opposite direction to that of the first stop member. The flexible arm acts on the balance-cock so that said flexible arm limits the rotation of stud-holder 3 by friction.

Of course, it will be understood that stud-holder 3 may be placed on the upper surface of balance-cock 5, but also on the lower surface, i.e. the surface facing the balance spring. This configuration on the lower surface allows stud 9 to be moved closer to the balance staff. This then makes it possible to use balance springs of small diameter.

To make stud-holder 3, several materials may be used According to a first solution, stud-holder 3 may be made of a plastic material such as polyurethane. The advantage of this material is that it can easily be shaped using moulding techniques and thereby ensures good reproducibility. Further, this material has good mechanical properties as it is easy to deform yet has good wear resistance.

According to a second solution metallic materials may be used. These materials fall into 2 categories: crystalline materials and amorphous materials.

Crystalline materials may be pure metals such as iron or aluminium, or alloys such as brass or steel. These metallic materials have the first advantage of exhibiting good mechanical properties. Indeed, metals have a high elastic limit allowing them to undergo high stress prior to plastic deformation. For example, aluminium has an elastic limit of 180 to 240 GPa, steel has an elastic limit of 235 to 1500 GPa depending on the type of steel, whereas glulam wood has an elastic limit of 32 GPa.

Further, these metallic materials have the advantage of being easy to shape. Indeed, it is possible to shape them by casting or injection moulding or by stamping, i.e. by press-cutting.

Further, it is possible to use the LIGA method consisting of X-ray lithography followed by galvanization by electroplating and ending with a shaping step. This LIGA method has the advantage of being inexpensive and quick to implement while ensuring good reproducibility and high precision production.

Amorphous metals also known as metallic glasses are materials with a disordered atomic-scale structure (non crystalline structure). In fact, in the case of an amorphous material, the $\sigma e/E$ ratio is increased by raising the limit of elasticity $\sigma e$. The stress beyond which the material does not return to its initial shape is therefore increased. This improvement in the $\sigma e/E$ ratio thus allows for greater deformation. This makes it possible to optimise the dimensions of the stud-holder and the elastic arms depending on whether it is desired to vary the pressure applied by the second stop member on the stud-holder.

Another advantage of these amorphous materials is that they offer new shaping possibilities for developing parts in complicated shapes with greater precision. Indeed, amorphous metals have the particular property of softening while remaining amorphous within a given temperature range [Tg–Tx] peculiar to each alloy (where Tx is the crystallisation temperature and Tg is the vitreous transition temperature). It is therefore possible to shape these metals under relatively low stress and at a low temperature. This means that fine geometries can be very accurately reproduced since the viscosity of the alloy is greatly decreased and the latter thus adopts all the details of the mould.

Another solution consists in using a single crystal material such as silicon. This material exhibits friction resistance properties, a high elastic limit and low density. This material is also attractive because of its antimagnetic properties and high corrosion resistance. A material such as silicon may be used since the system according to the present invention permits assembly/disassembly of stud 9 without shocks.

To create such a part from silicon, known LIGA or DRIE methods are used and provide good reproducibility and high precision parts.

In a third embodiment, stud-holder 3 and balance-cock 5 are made in one-piece, i.e. they form the same single component. In this regard, balance-cock 5 acts as base 3, which includes the first stop member and from which extend the elastic arm or arms 35, 350 forming elastic means 34, 340.

This third embodiment eliminates the need for means 7 for attaching stud-holder 3 to balance-cock 5. There is consequently a risk of improper positioning during the assembly of the stud-holder to the balance-cock.

Further, this third embodiment reduces costs since there is only one part instead of two and the method contains one less step.

It will be clear that various alterations and/or improvements and/or combinations evident to those skilled in the art may be made to the various embodiments of the invention set out above without departing from the scope of the invention defined by the annexed claims.

Figure 8:
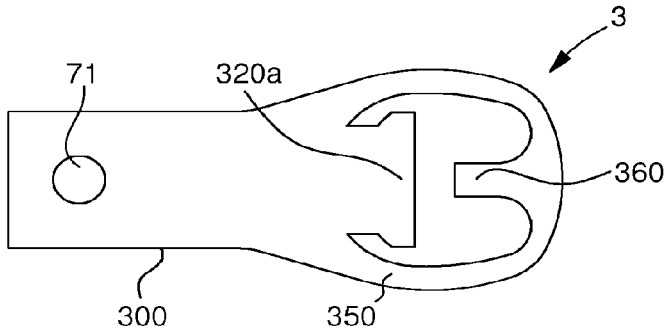
FIG. 8 shows a diagram of a variant of the invention.

For example, the first stop member may be configured to act as a stop member for the elastic arms. Indeed, depending on the dimensions and material forming the arms, there is a risk of breakage or plastic deformation. To overcome this problem, first stop member 320*a* visible in FIG. 8 is devised to extend in width so as to have a larger width than that of base 300. This feature makes it possible to limit the displacement of arms 350 when stress C' is applied. Consequently, the deformation of arms 350 is limited and the risk of breakage is reduced It is also possible for the stud, the first stop member and/or the second stop member to be provided with a flat portion so as to prevent the stud rotating on itself.

What is claimed is:

1. An assembly for holding or supporting a timepiece balance spring, including a balance spring stud and a stud-holder, wherein the stud-holder includes:

a base comprising a first stop member extending along a longitudinal axis of said base;

means of attaching said stud-holder to a balance-cock, wherein said stud-holder further includes elastic means provided with a second stop member, the elastic means extending along said longitudinal axis of said base such that the second stop member is located facing the first stop member, the space between said first stop member and said second stop member forming a housing for said stud, and in that the elastic means are made to naturally exert stress on the stud when the latter is placed in the housing, the housing being capable of enlargement to release the stud by deformation of said elastic means, said elastic means including two arms extending from said base, the arms being joined to each other and having a convex shape such that the application of a stress to the two arms intended to move them closer together causes a displacement of the second stop member intended to enlarge the housing.

2. The holding assembly according to claim 1, wherein the two arms forming the elastic means are symmetrical with respect to the longitudinal axis of said base.

3. The holding assembly according to claim 1, wherein each of the two arms includes a notch.

4. The holding assembly according to claim 1, wherein the stud-holder is made of a plastic material.

5. The holding assembly according to claim 1, wherein the stud-holder is made of a metallic material.

6. The holding assembly according to claim 1, wherein the stud-holder is made of a single crystal material.

7. The holding assembly according to claim 1, wherein the means of attachment include a hole arranged in the balance-cock cooperating with a first hole of the stud-holder and a screw inserted in both holes.

8. The holding assembly according to claim 7, wherein the means of attachment further comprise a lug arranged on the balance-cock and a second hole arranged in the stud-holder, said lug cooperating with the second hole.

9. The holding assembly according to claim 7, wherein the means of attachment further comprise a lug arranged on the stud-holder and a second hole arranged in the balance-cock, said lug cooperating with the second hole.

10. The holding assembly according to claim 7, wherein the means of attachment further comprise a protuberance arranged on the balance-cock and a recess arranged in the stud-holder, said recess cooperating with said protuberance.

11. The holding assembly according to claim 10, wherein said protuberance and said recess have the same dimensions.

12. The holding assembly according to claim 8, wherein the second hole has the shape of an arc of a circle, said second hole extending at a greater angle than said lug allowing the stud-holder to pivot angularly.

13. The holding assembly according to claim 9, wherein the second hole has the shape of an arc of a circle, said second hole extending at a greater angle than said lug allowing the stud-holder to pivot angularly.

14. The holding assembly according to claim 10, wherein the first hole has the shape of an arc of a circle, said recess extending at a greater angle than said protuberance allowing the stud-holder to pivot angularly.

15. The holding assembly according to claim 1, wherein the stud-holder and the balance-cock are in one-piece.

* * * * *